US010774700B2

(12) United States Patent
Perotto et al.

(10) Patent No.: US 10,774,700 B2
(45) Date of Patent: Sep. 15, 2020

(54) LUBRICATING NOZZLE WITH SIMPLIFIED PRODUCTION

(71) Applicant: BONTAZ CENTRE R & D, Marnaz (FR)

(72) Inventors: Stéphane Pascal Perotto, Ayse (FR); Anthony Raymond Arthur Taupeau, Poisy (FR); Dylan Mohamed, Annemasse (FR)

(73) Assignee: BONTAZ CENTRE R & D, Marnaz (FR)

( * ) Notice: Subject to any disclaimer, the term of this patent is extended or adjusted under 35 U.S.C. 154(b) by 32 days.

(21) Appl. No.: 15/999,138

(22) PCT Filed: Feb. 16, 2017

(86) PCT No.: PCT/EP2017/053562
§ 371 (c)(1),
(2) Date: Aug. 17, 2018

(87) PCT Pub. No.: WO2017/140817
PCT Pub. Date: Aug. 24, 2017

(65) Prior Publication Data

US 2019/0063274 A1 Feb. 28, 2019

(30) Foreign Application Priority Data

Feb. 17, 2016 (FR) ..... 16 51282

(51) Int. Cl.
*F01M 1/08* (2006.01)
*F01P 3/08* (2006.01)
*F01P 3/00* (2006.01)

(52) U.S. Cl.
CPC ..... *F01M 1/08* (2013.01); *F01P 3/08* (2013.01); *F01P 2003/006* (2013.01)

(58) Field of Classification Search
CPC ..... F01M 1/08; F01M 1/16; F01M 2001/083; F01P 3/08; F01P 2003/006; F01P 3/06; F16K 31/122
See application file for complete search history.

(56) References Cited

U.S. PATENT DOCUMENTS 6,866,011 B1 * 3/2005 Beardmore ..... F01M 1/08 123/41.35
9,476,344 B2 * 10/2016 Clement ..... F01P 3/08
(Continued)

FOREIGN PATENT DOCUMENTS

EP 1571306 A2 9/2005
EP 2789824 A1 10/2014

OTHER PUBLICATIONS

International Search Report for International Application No. PCT/EP2017/053562, dated May 16, 2017.
(Continued)

*Primary Examiner* — Syed O Hasan
(74) *Attorney, Agent, or Firm* — Pearne & Gordon LLP

(57) ABSTRACT

A lubricating nozzle comprising a metal spray nozzle body comprising a contact surface, the spray nozzle body comprising an axial channel opening out onto the contact surface, a retaining screw, and an orienting plate. The spray nozzle body is mounted inside the hole such that it abuts against a first face of the orienting plate, and such that the contact surface of the body is flush with a second face (106*b*) of the orienting plate opposite the first face, the spray nozzle body and the orienting plate (106) comprising a first complementary orienting structure which engages such that the oil outlet is oriented, according to a predetermined orientation relative to the first orienting structure, the orienting plate (106) further comprising a second orienting structure designed to orient the plate on the engine block.

14 Claims, 4 Drawing Sheets

(56) References Cited

U.S. PATENT DOCUMENTS

| | | | | |
|---|---|---|---|---|
| 2005/0092265 | A1* | 5/2005 | Dunbar | F01M 1/08 123/41.35 |
| 2006/0169224 | A1* | 8/2006 | Lenz | F01M 1/08 123/41.35 |
| 2014/0305392 | A1 | 10/2014 | Clement et al. | |
| 2016/0047290 | A1 | 2/2016 | Clement et al. | |
| 2017/0130746 | A1 | 5/2017 | Taupeau et al. | |

OTHER PUBLICATIONS

Written Opinion for International Application No. PCT/EP2017/053562, dated May 16, 2017.
Preliminary French Search Report for Application No. 1651282, dated Dec. 13, 2016.

* cited by examiner

LUBRICATING NOZZLE WITH SIMPLIFIED PRODUCTION

TECHNICAL FIELD AND PRIOR ART

This invention relates to a piston cooling spray nozzle and/or to an internal combustion engine chain lubricating nozzle.

A spray nozzle, as shown in FIGS. 1*a* and 1*b*, is an oil spraying device, for example on the piston head of an internal combustion engine.

The spray nozzle 10 can also be intended to dispense oil onto an internal combustion engine chain.

In this respect, a lubricating nozzle 10, known by a person skilled in the art, is intended to cool the piston head or lubricate the chains of an internal combustion engine, the spray nozzle 10 comprising:

a metal spray nozzle body 11 comprising a first end, said first end having a contact surface 13, the spray nozzle body 11 comprising an axial channel 12 opening out onto the contact surface 13, and thus forming an oil inlet, the spray nozzle body 11 further comprising a lateral channel communicating with the axial channel 12, the spray nozzle body 11 further comprising a second end connected to the first end via a lateral surface 15, the lateral channel opening out onto the lateral surface 15 to form an oil outlet;

a retaining screw 16, opening out onto the contact surface 13 of the spray nozzle body 11, intended to imperviously clamp the contact surface 13 of the spray nozzle body against the block of an internal combustion engine, and imperviously connect the oil inlet of the spray nozzle body 11 to an oil supply of said block;

an orienting plate 17 comprising a hole into which the spray nozzle is inserted;

However, said device is not satisfactory.

More specifically during operation, a lubricating nozzle must be precisely positioned and oriented inside the engine block in order to guarantee a suitable direction of the oil jet relative to the parts to be cooled and/or lubricated.

Moreover, the assembly of the spray nozzle inside the engine block must guarantee that it will not collide with the surrounding engine components.

To achieve this, a step of orienting the oil outlet of the spray nozzle body 11 relative to the orienting plate is generally performed by brazing the components of the lubricating nozzle, whereafter the latter is positioned in the internal combustion engine and secured using a retaining screw 16.

The soldering step is used to rigidly connect the body of the spray nozzle and the orienting plate to one another and thus guarantee the stability of the orientation of the spray nozzle inside the internal combustion engine.

This configuration thus requires the use of metal materials which significantly add to the weight of the lubricating nozzle.

Moreover, the brazing steps complicate the manufacture of such spray nozzles and above all are very costly.

One purpose of this invention is thus to propose a lubricating nozzle with simplified production.

Another purpose of the invention is to propose a spray nozzle, the weight whereof is reduced relative to the spray nozzles of the prior art.

DESCRIPTION OF THE INVENTION

The above purposes are at least partially achieved by a lubricating nozzle comprising:

a metal spray nozzle body comprising a first end, said first end having a contact surface, the spray nozzle body comprising an axial channel opening out onto the contact surface, and thus forming an oil inlet, the spray nozzle body further comprising a lateral channel communicating with the axial channel, the spray nozzle body further comprising a second end connected to the first end via a lateral surface, the lateral channel opening out onto the lateral surface to form an oil outlet;

a retaining screw, opening out onto the contact surface of the spray nozzle body, intended to imperviously clamp the contact surface of the spray nozzle body against the block of an engine, and imperviously connect the oil inlet of the spray nozzle body to an oil supply of said casing;

an orienting plate comprising a hole into which the spray nozzle is inserted;

the spray nozzle body being mounted inside the hole, such that it abuts against a first face of the orienting plate via abutment means, and such that the contact surface of said body is flush with a second face of the orienting plate opposite the first face, the spray nozzle body and the orienting plate comprising first complementary orienting means which engage such that the oil outlet is oriented, according to a predetermined orientation relative to said first orienting means, the orienting plate further comprising second orienting means designed to orient said plate on the engine block.

According to one particularly advantageous embodiment, the orienting plate is made of a plastic material.

According to another embodiment, the abutment means comprise a head of the retaining screw, such that said head is at rest on the first face of the orienting plate when the retaining screw clamps the contact surface against the block of an engine.

According to one embodiment, the abutment means comprise a first shoulder formed on the lateral surface of the spray nozzle body intended to ensure the mounting and abutment of the spray nozzle body inside the hole of the orienting plate.

The abutment means can further comprise a second shoulder, complementary to the first shoulder, formed on the inner surface of the hole of the orienting plate.

According to one embodiment, the spray nozzle comprises an injection tube including a first end and a second end, the first end being imperviously connected to the oil outlet, and the second end being intended to direct the oil jet when the lubricating nozzle is in operation.

According to one embodiment, the first complementary orienting means are formed on the lateral surface of the spray nozzle body and on the inner surface of the hole of the orienting plate.

For example, the first complementary orienting means comprise a flat section formed on the lateral surface of the spray nozzle body and a flat section formed on the inner surface of the hole, said flat sections being intended to be placed in contact with one another in order to orient the oil outlet relative to the orienting plate.

According to one embodiment, the first complementary orienting means comprise lateral abutments positioned on the first face of the orienting plate, the lateral abutments being positioned such that they guide the injection tube, such that the oil outlet is oriented in the predetermined direction.

According to one embodiment, the second orienting means comprise a lug, formed on the second face of the orienting plate, and intended to be inserted into an orienting hole of the engine block.

According to another embodiment, the first face and the second face of the orienting plate are connected via a second lateral surface, the second orienting means comprising at least a flat section formed on the second lateral surface, intended to be in contact with a flat section formed on the engine block.

BRIEF DESCRIPTION OF THE FIGURES

This invention shall be better understood upon reading the following description with reference to the appended figures, wherein.

DETAILED DESCRIPTION OF THE SPECIFIC EMBODIMENTS

FIGS. 2 to 5 show one example embodiment of a lubricating nozzle according to this invention, suitable for cooling a piston or for lubricating a chain of an internal combustion engine.

The lubricating nozzle 100 comprises a spray nozzle body 101.

The spray nozzle body 101 can be made of a metal material. For example, in a non-limitative manner, the spray nozzle body 101 can be made of steel.

The spray nozzle body 101 comprises a first end 101*a* and a second end 101*b*. The first end has a contact surface 101*d*, and the second end has an exposed surface 101*e*. The contact surface 101*d* and the exposed surface 101*e* are connected by a lateral surface 101*c*.

The lateral surface 101*c* can be rotationally symmetrical.

Figure 1A:
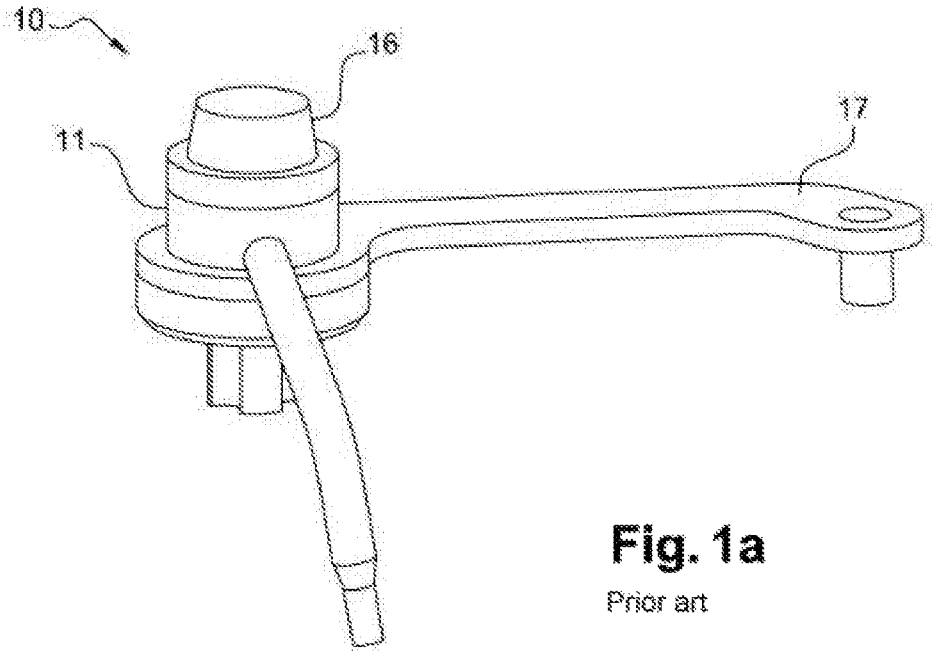
Fig. 1a Prior art
FIG. 1*a* is a diagram showing a perspective view of a known lubricating nozzle from the prior art.
Figure 1B:
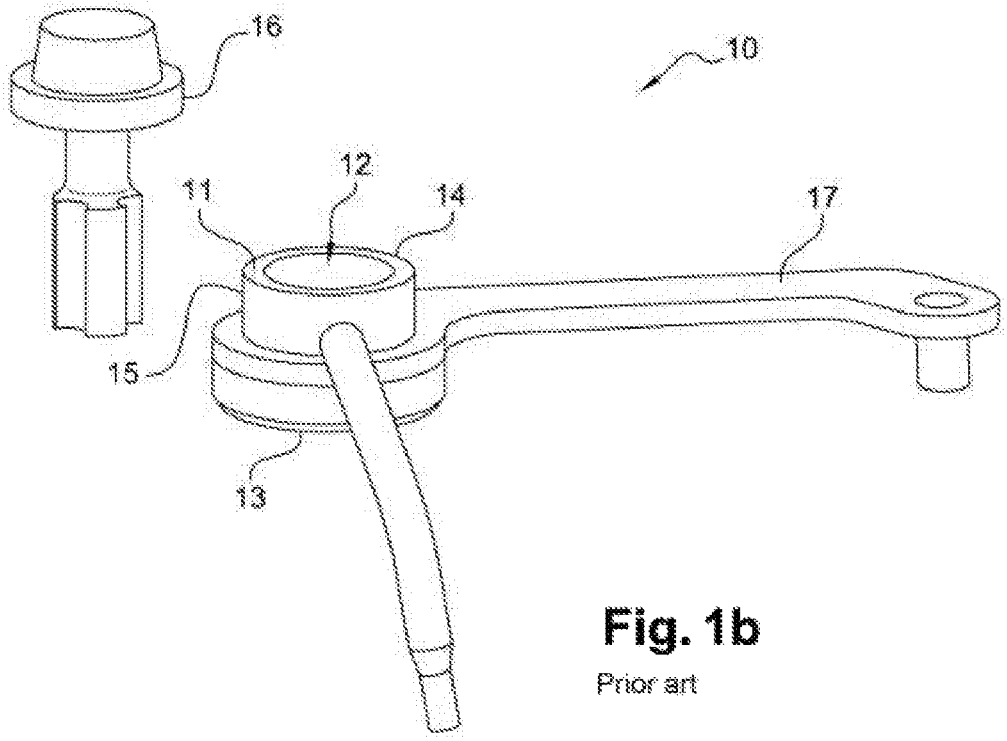
Fig. 1b Prior art
FIG. 1*b* is a diagram showing a partially-exploded, perspective view, after removal of the retaining screw, of a known lubricating nozzle from the prior art.
Figure 2:
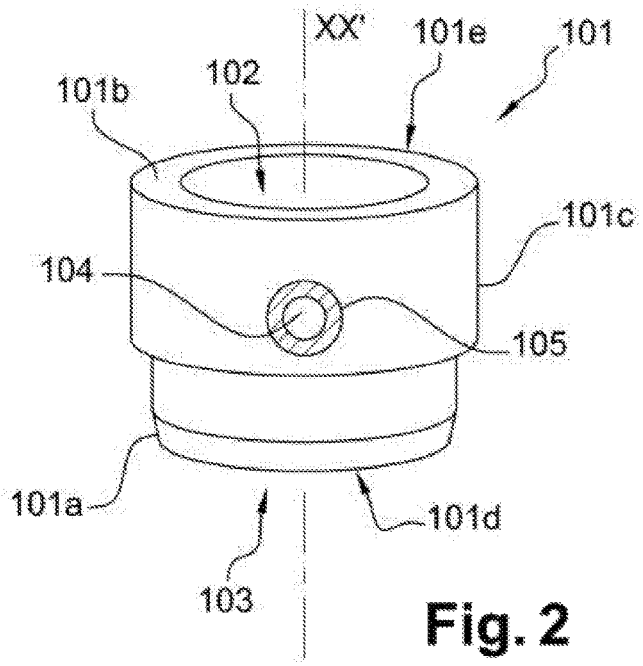
FIG. 2 is a perspective view of a spray nozzle body according to the invention.

The spray nozzle body 101 comprises an axial channel 102 oriented along the axis XX' in FIG. 2.

The axial channel 102 opens out onto the contact surface 101*d* of the spray nozzle body 101. The intersection of the axial channel 102 with the contact surface 101*d* forms an opening, referred to as an oil inlet 103. The contact surface 101*d* of the spray nozzle body 101 is intended to be placed in contact with a surface element of the engine block. The surface element of the engine block comprises an oil feed intended to be connected to the oil inlet 103.

The axial channel 102 can also open out onto the second end 101*b*.

The spray nozzle body 101 further comprises a lateral channel 104. The lateral channel 104 communicates with the axial channel 102 and opens out onto the lateral surface 101*c*. The intersection of the lateral channel 104 with the lateral surface 101*c* forms an opening, referred to as an oil outlet 105.

Figure 3:
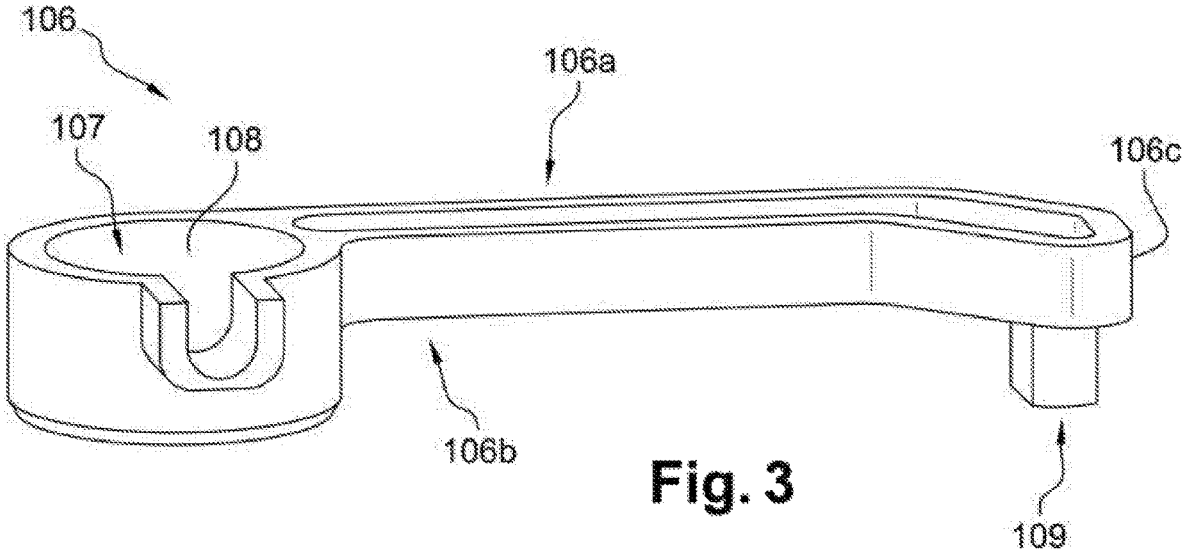
FIG. 3 is a perspective view of the orienting plate according to the invention.

The lubricating nozzle 100 further comprises an orienting plate 106 (FIG. 3). The orienting plate 106 comprises a first face 106*a* and a second face 106*b* connected to one another by a second lateral surface 106*c*.

Advantageously, the orienting plate 106 can be made of a plastic material, for example of a loaded thermoplastic material, advantageously made of glass fibre-loaded polyamide. Plastic materials have the advantage of making the lubricating nozzle 100 lighter than known nozzles in the prior art. Moreover, an orienting plate 106 made of a plastic material, and more particularly made of a thermoplastic material, can be easily manufactured using injection/moulding methods capable of being repeated in large series.

The orienting plate 106 can be made of any material, for example a metal alloy.

The orienting plate 106 comprises a hole 107 passing through the orienting plate 106 from end to end. More specifically, the hole 107 opens out onto the first face 106*a* and the second face 106*b*.

The hole 107 is intended to house the spray nozzle body 101. More particularly, the spray nozzle body 101 is mounted such that it abuts inside the hole 107 against the first face 106*a*. The mounting and abutment are achieved using abutment means. The abutment means are suitable for preventing any movement of the orienting plate along the axis XX' of the spray nozzle body 101 when the nozzle 100 is mounted on the block of an engine for example.

The mounting and abutment can be obtained using a so-called first shoulder 101*f* of the lateral surface 101*c* of the spray nozzle body 101.

Figure 4A:
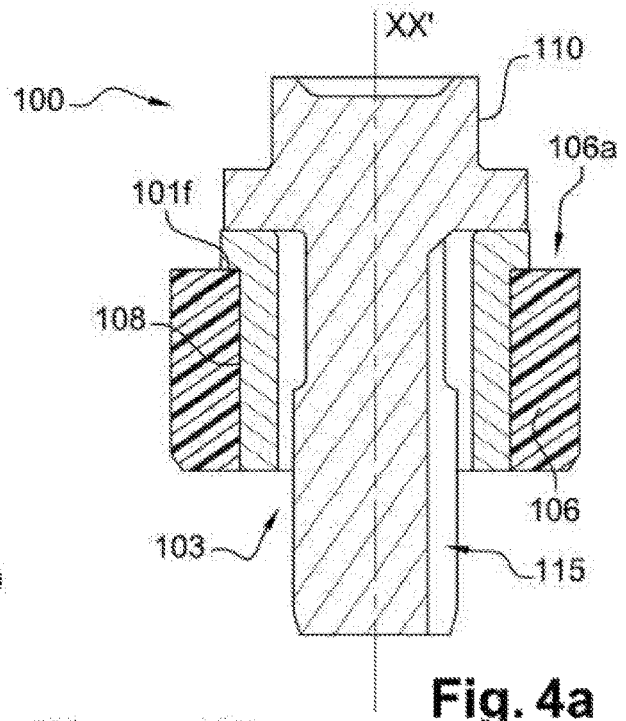
FIG. 4*a* is a longitudinal sectional view of the lubricating nozzle according to the invention, wherein the mounting and abutment of the body of the spray nozzle are achieved using a single shoulder.

In one advantageous embodiment shown in FIG. 4*a*, the first shoulder 101*f* of the lateral surface 101*c* is at rest against the first face 106*a*, such that the inner surface 108 of the hole 107 does not require any additional shoulder.

In another advantageous embodiment (FIG. 4*b*), the inner surface 108 of the hole 107 further comprises a shoulder, the shape whereof is complementary to that of the first shoulder, referred to as a second shoulder 107*a*. In this arrangement, the first shoulder is at rest on the second shoulder so as to ensure the mounting of the spray nozzle body such that it abuts against the first face 106*a*.

The mounting of the spray nozzle body 101 such that it abuts against the first face 106*a* is not limited to the formation of shoulders. The lateral surface 101*c* and the inner surface 108 can, for example, be conical in shape.

Upon reading the remainder of the description below and with reference to FIG. 4*c*, the mounting of the spray nozzle body 101 such that it abuts against the first face 106*a* can be seen to be achieved using the retaining screw 110.

Moreover, according to the invention, the contact surface 101*d* of the spray nozzle body 101 is flush with the second face 106*b* of the orienting plate 106.

Again according to the invention, the orienting plate 106 and the spray nozzle body 101 comprise first complementary orienting means for orienting the oil outlet 105.

Said first complementary orienting means are intended to orient the oil outlet 105 relative to the orienting plate 106.

The orienting plate 106 further comprises second orienting means intended to orient said orienting plate 106 inside the engine block.

Thus, the first complementary orienting means and the second orienting means are suitable for orienting the oil outlet 105 relative to the engine block.

The first complementary orienting means will now be described.

According to a first embodiment, the first complementary orienting means can be formed from an inner surface 108 of the non-circular hole 107 (not shown). For example, the inner surface of the hole 108 can comprise one or more flat sections. Additionally, the section of the lateral surface 101*c* of the spray nozzle body 101 in contact with the inner surface 108 of the hole 107 can further comprise one or more flat sections intended to be connected with the one or more flat sections of the inner surface 108 of the hole 107. Thus, the interlocking, flat section against flat section, of the spray nozzle body 101 inside the hole 107 will allow the oil outlet 105 to be oriented relative to the orienting plate 106.

According to a second alternative and/or complementary embodiment, the spray nozzle body 101 can comprise an injection tube 112 (FIG. 4*b*) connected, in an impervious manner, to the oil outlet 105. Thus, the injection tube 112 includes a first end and a second end, the first end being imperviously connected to the oil outlet 105, and the second end being intended to direct the oil jet when the lubricating nozzle is in operation. The injection tube 112 can advantageously rest on the first face 106*a* of the orienting plate 106. Moreover, lateral abutments are positioned on the first face 106*a* and on either side of the injection tube 112 so as to prevent any rotational movement of the spray nozzle body 101 relative to the orienting plate 106, when inserted into the hole 107.

In other words, the injection tube 112 is guided by the lateral abutments. The lateral abutments can, for example, be formed by a groove for receiving the injection tube 112 (FIG. 3). Such an arrangement thus allows the oil outlet 105 to be oriented relative to the orienting plate 106.

The orienting plate 106 further comprises second orienting means intended to orient said plate 106 relative to the engine block. The second orienting means, shown in FIG. 3, can comprise, for example, a lug 109 positioned on the second face 106*b* of the plate 106 and intended to be inserted into a hole in the engine block (not shown).

Figure 5:
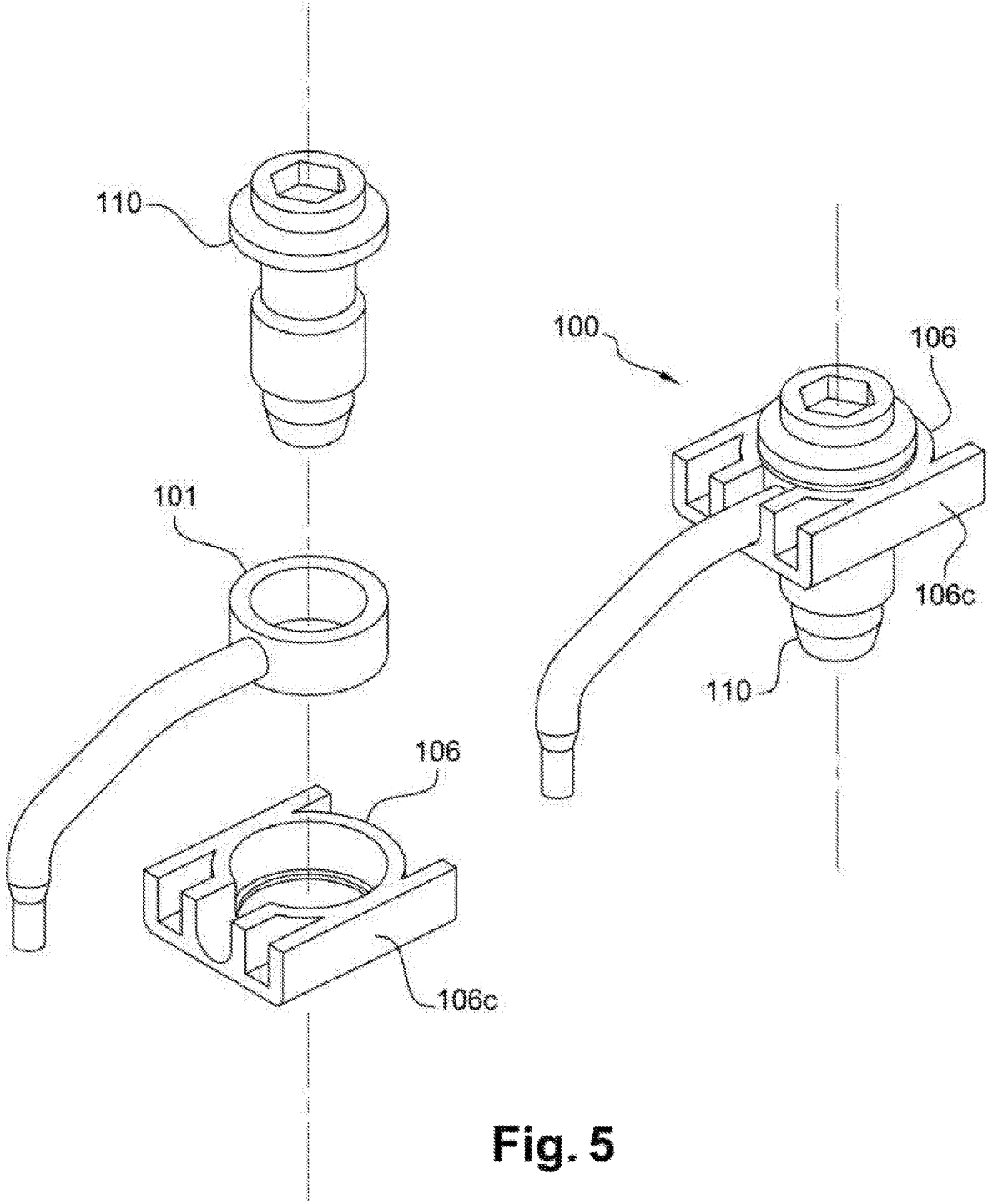
FIG. 5 shows an exploded view of a lubricating nozzle according to a second embodiment of the invention.

Alternatively, as shown in FIG. 5, the second orienting means can further comprise a flat section formed on the lateral surface 106*c* of the plate 106. The orienting plate 106 can have a plurality of flat sections, for example 2, 3 or 4 flat sections so as to provide said plate with a square shape.

A complementary shape is also formed on the engine block, for example a flat shape, intended to engage with the flat section formed on the lateral surface 106*c* of the orienting plate 106.

Thus, the orientation of the orienting plate 106 relative to the engine block, and the orientation of the oil outlet 105 relative to said plate 106 allows a precise orientation of the oil outlet 105 to be obtained inside the engine block.

The first complementary orienting means and the second orienting means do not require brazing in order to fix the orientation of the spray nozzle body 101 relative to the orienting plate 106 and relative to the engine block.

The nozzle 100 further comprises a retaining screw 110, opening out onto the contact surface 101*d* of the spray nozzle body 101. The retaining screw 110 is intended to imperviously clamp the contact surface 101*d* of the spray nozzle body 101 against the casing of the internal combustion engine, and imperviously connect the oil inlet 103 of the spray nozzle body 101 to the oil supply of said casing.

Advantageously, the retaining screw 110 is mounted in a coaxial manner to the axial channel 102 such that it opens out onto the contact surface 101*d* of the spray nozzle body 101 at the oil inlet 103. The clamping of the retaining screw in the oil supply hole of the engine allows the lubricating nozzle 100 to be held in a stable position.

The retaining screw 110 is also suitable for allowing oil to flow from the engine supply hole to the axial channel. For this purpose, a recess 115 (FIG. 4*a*) can be formed along the length of the screw thread along the axis of revolution thereof. The retaining screw 110 can also be hollow, i.e. it can comprise a channel formed in the volume thereof along the axis of revolution thereof in order to guide the oil from the oil inlet to the lateral channel 104.

The retaining screw can pass through the spray nozzle body 101 from end to end, from the exposed surface 101*e* thereof to the contact surface 101*d* thereof.

Figure 4B:
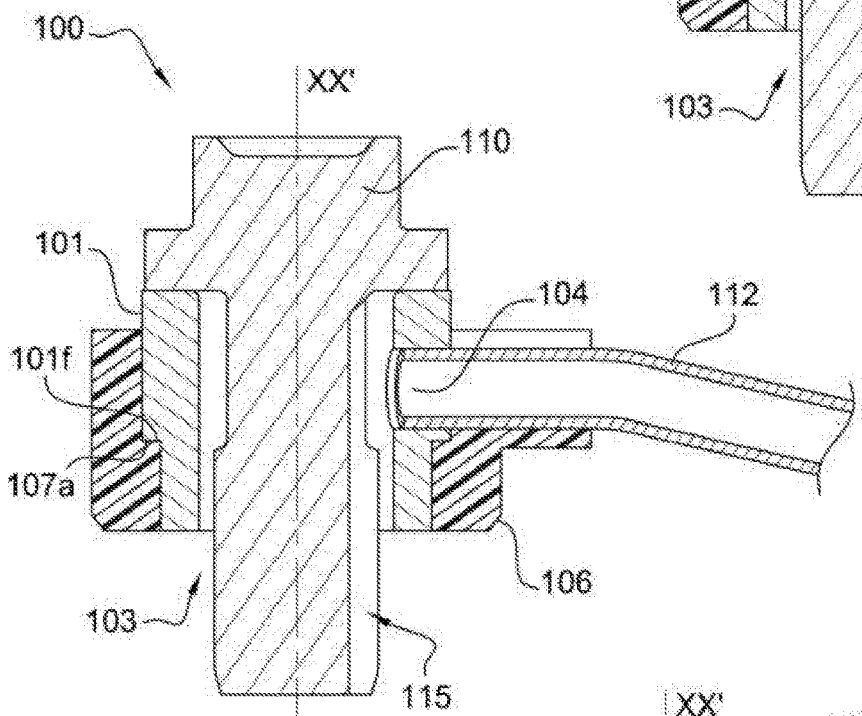
FIG. 4*b* is a longitudinal sectional view of the lubricating nozzle according to the invention, wherein the mounting and abutment of the body of the spray nozzle are achieved using one shoulder on the lateral surface of the spray nozzle body and one shoulder on the inner surface of the hole.
Figure 4C:
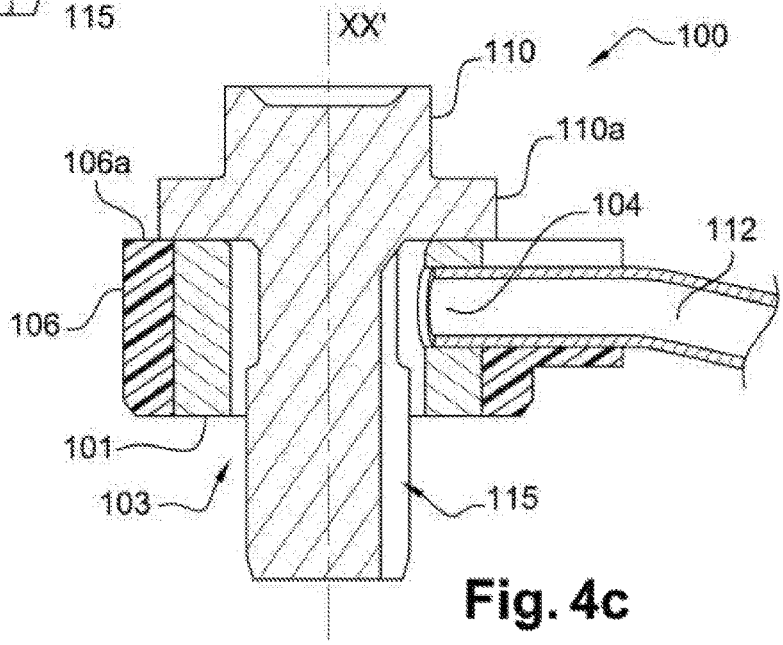
FIG. 4*c* is a longitudinal sectional view of the lubricating nozzle according to the invention, wherein the mounting and abutment of the body of the spray nozzle are achieved by the screw head of the retaining screw, whereby the screw head is at rest against the first surface of the orienting plate.

Alternatively to the embodiments of the abutment means shown in FIGS. 4*a* and 4*b*, FIG. 4*c* shows another embodiment of the abutment means. In this embodiment, the abutment means comprise the screw head 110*a* of the retaining screw 110. When the retaining screw 110 clamps the contact surface 101*d* against, for example, the engine block, the screw head 110*a* of the retaining screw is at rest against the first face 106*a* of the orienting plate such that it prevents any movement of the orienting plate 106 along the axis XX' of the spray nozzle body 101.

In a particularly advantageous manner, the fact of having the contact surface 101*d* flush with the second face 106*b* of the orienting plate 106 minimises the stresses exerted on said plate when the retaining screw 110 imperviously clamps the contact surface 101*d* of the spray nozzle body 101 against the casing of an internal combustion engine.

Thus, the minimisation of the stresses applied to said plate allows for the use of plastic materials, such as glass fibre-loaded thermoplastic materials. Moreover, when using plastic materials to produce the orienting plate 106, the clamping of the retaining screw can be adjusted such that the stress exerted on said plate 106 is less than the elastic limit of the plastic material.

Moreover, the use of an orienting plate 106 made of a plastic material has no effect on the mechanical strength and/or deterioration of the functioning of the nozzle 100 according to the invention.

This document will now describe the assembly of the nozzle 100 in FIG. 4*b*.

The assembly comprises the provision of the spray nozzle body 101. The injection tube 112 is then also inserted into the oil outlet hole 105.

The injection tube 112/spray nozzle body 101 assembly is then brazed so as to fix, in a permanent and impervious manner, the injection tube 112 onto the spray nozzle body 101. The brazing step is performed using techniques known to a person skilled in the art and is therefore not described herein.

The injection tube 112/spray nozzle body 101 assembly is inserted into the hole 107 via the first face 106*a* of the orienting plate 106, and such that it abuts against said first face 106*a*. The abutment function is obtained by the first shoulder 101*f*, and potentially by the second shoulder 107*a* described hereinabove. The oil outlet 105 is oriented relative to the orienting plate 106 by the first complementary orienting means during insertion of the spray nozzle body 101 into the hole 107. The oil outlet can, for example, be oriented by installing the injection tube 112 between the two lateral abutments or inside the groove. The injection tube 112 can be folded so as to orient the oil jet.

Finally, the assembly comprising the spray nozzle body 101, the injection tube 112 and the orienting plate 106 can then be assembled onto the engine block such that it connects the oil inlet 103 of the orienting plate with an oil supply of said engine.

During the assembly step, the orienting plate 106 is oriented relative to the engine casing using second orienting means. The lug 109 is, for example, inserted into a hole formed in the casing of the engine.

The clamping screw 110 thus secures, in a stable manner, the nozzle thus formed.

This manufacturing method requires fewer assembly steps compared to known nozzles of the prior art.

Moreover, the nozzle 100 according to the invention makes it possible to use plastic materials to manufacture the orienting plate 106, which reduces production costs.

What is claimed is:

1. Lubricating nozzle comprising:

a metal spray nozzle body comprising a first end, said first end having a contact surface, the spray nozzle body comprising an axial channel opening out onto the contact surface, and thus forming an oil inlet, the spray nozzle body further comprising a lateral channel communicating with the axial channel, the spray nozzle body further comprising a second end connected to the first end via a lateral surface, the lateral channel opening out onto the lateral surface to form an oil outlet;

a retaining screw, opening out onto the contact surface of the spray nozzle body intended to imperviously clamp the contact surface of the spray nozzle body against the block of an engine, and imperviously connect the oil inlet of the spray nozzle body to an oil supply of the block of the engine;

an orienting plate comprising a hole into which the spray nozzle is inserted;

wherein the spray nozzle body is mounted inside the hole, such that it abuts against a first face of the orienting plate via abutment means, and such that the contact surface of said body is flush with a second face of the orienting plate opposite the first face, the spray nozzle body and the orienting plate comprising first complementary orienting means which engage such that the oil outlet is oriented, according to a predetermined orientation relative to said first orienting means, the orienting plate further comprising second orienting means designed to orient said plate on the engine block.

2. Nozzle according to claim 1, wherein the orienting plate is made of a plastic material.

3. Nozzle according to claim 1, wherein the abutment means comprise a screw head of the retaining screw, such that said head is at rest on the first face of the orienting plate when the retaining screw clamps the contact surface against the block of an engine.

4. Nozzle according to claim 2, wherein the abutment means comprise a screw head of the retaining screw, such that said head is at rest on the first face of the orienting plate when the retaining screw clamps the contact surface against the block of an engine.

5. Nozzle according to claim 1, wherein the abutment means comprise a first shoulder formed on the lateral surface intended to ensure the mounting and abutment of the spray nozzle body inside the hole of the orienting plate.

6. Nozzle according to claim 5, wherein the abutment means further comprise a second shoulder, complementary to the first shoulder, formed on the inner surface of the hole of the orienting plate.

7. Nozzle according to claim 2, wherein the abutment means comprise a first shoulder formed on the lateral surface intended to ensure the mounting and abutment of the spray nozzle body inside the hole of the orienting plate.

8. Nozzle according to claim 7, wherein the abutment means further comprise a second shoulder, complementary to the first shoulder, formed on the inner surface of the hole of the orienting plate.

9. Nozzle according to claim 1, wherein the nozzle comprises an injection tube including a first end and a second end, the first end being imperviously connected to the oil outlet, and the second end being intended to direct the oil jet when the lubricating nozzle is in operation.

10. Nozzle according to claim 1, wherein the first complementary orienting means are formed on the lateral surface of the spray nozzle body and on the inner surface of the hole of the orienting plate.

11. Nozzle according to claim 10, wherein the first complementary orienting means comprise a flat section formed on the lateral surface of the spray nozzle body and a flat section formed on the inner surface of the hole, said flat sections being intended to be placed in contact with one another in order to orient the oil outlet relative to the orienting plate.

12. Nozzle according to claim 9, wherein the first complementary orienting means comprise lateral abutments positioned on the first face of the orienting plate, the lateral abutments being positioned such that they guide the injection tube, such that the oil outlet is oriented in the predetermined direction.

13. Nozzle according to claim 1, wherein the second orienting means comprise a lug, formed on the second face of the orienting plate, and intended to be inserted into an orienting hole of the engine block.

14. Nozzle according to claim 1, wherein the first face and the second face of the orienting plate are connected via a second lateral surface, the second orienting means comprising at least a flat section formed on the second lateral surface, intended to be in contact with a flat section formed on the engine block.

* * * * *